US012281801B2

(12) United States Patent
Rizzuto

(10) Patent No.: US 12,281,801 B2
(45) Date of Patent: Apr. 22, 2025

(54) COMBINATION HEAT AND STEAM OVEN

(71) Applicant: Leandro P. Rizzuto, Sheriden, WY (US)

(72) Inventor: Leandro P. Rizzuto, Sheriden, WY (US)

(73) Assignee: Conair LLC, Stamford, CT (US)

( * ) Notice: Subject to any disclaimer, the term of this patent is extended or adjusted under 35 U.S.C. 154(b) by 648 days.

(21) Appl. No.: 14/445,529

(22) Filed: Jul. 29, 2014

(65) Prior Publication Data

US 2016/0033141 A1 Feb. 4, 2016

(51) Int. Cl.

| | |
|---|---|
| ***F24C 7/08*** | (2006.01) |
| ***F24C 14/00*** | (2006.01) |
| ***F24C 15/32*** | (2006.01) |

(52) U.S. Cl.

CPC ..... *F24C 7/085* (2013.01); *F24C 14/00* (2013.01); *F24C 15/327* (2013.01)

(58) Field of Classification Search

CPC ..... F24C 7/085; F24C 14/00; F24C 15/327; F24C 15/003; A47J 27/00; A47J 27/04; A47J 27/16; A47J 27/17; A47J 37/08; A47J 37/0807; A21B 1/08; A21B 1/22; A21B 1/24; A21B 1/36; A21B 3/04

USPC ..... 426/231, 233, 510, 511, 523; 219/395, 219/396, 398, 401, 402, 473; 99/340, 99/467

See application file for complete search history.

(56) References Cited

U.S. PATENT DOCUMENTS

| | | | | |
|---|---|---|---|---|
| 3,456,578 | A | 7/1969 | Pinsly | |
| 4,700,685 | A | 10/1987 | Miller | |
| 4,810,856 | A * | 3/1989 | Jovanovic | F24C 15/164 219/401 |
| 4,817,582 | A | 4/1989 | Oslin et al. | |
| 4,851,644 | A | 7/1989 | Oslin | |
| 5,080,087 | A | 1/1992 | McFadden et al. | |
| 5,515,773 | A | 5/1996 | Bullard | |
| 5,680,810 | A * | 10/1997 | Sham | A47J 27/16 126/20 |
| 5,875,705 | A | 3/1999 | Knost | |
| 6,100,502 | A | 8/2000 | Sham et al. | |
| 6,572,911 | B1 | 6/2003 | Corcoran et al. | |
| 6,972,397 | B2 * | 12/2005 | Ha | F24C 15/327 126/20 |
| 7,093,592 | B2 * | 8/2006 | Cho | A21B 3/04 239/548 |
| 7,335,859 | B2 | 2/2008 | Nevarez | |
| 7,745,763 | B2 | 6/2010 | Fraccon et al. | |
| 7,765,918 | B2 | 8/2010 | Garniss et al. | |

(Continued)

*Primary Examiner* — Brian W Jennison

(74) *Attorney, Agent, or Firm* — Grogan, Tuccillo & Vanderleeden, LLP

(57) ABSTRACT

A combination heat and steam oven according to the present invention includes a housing having an internal heating compartment, at least one dry heating element disposed within the heating compartment, a steam generating unit configured to produce steam for injection into the heating compartment, and a user interface. The user interface is configured for selectively controlling operation of the at least one dry heating element and the steam generating unit, so that the steam generating unit and the at least one dry heating element may be operated alone or simultaneously with the other of the steam generating unit and the at least one dry heating element.

7 Claims, 2 Drawing Sheets

(56) References Cited

U.S. PATENT DOCUMENTS

| | | | | |
|---|---|---|---|---|
| 8,193,470 | B1 * | 6/2012 | Harlamert | F24C 14/005 126/20 |
| 8,215,232 | B2 * | 7/2012 | Lee | F24C 7/08 99/467 |
| 2008/0017629 | A1 * | 1/2008 | Xu | F24C 15/327 126/369 |
| 2009/0136640 | A1 * | 5/2009 | Embury | A23L 5/13 426/510 |
| 2009/0250452 | A1 * | 10/2009 | Tse | F24C 15/327 219/400 |
| 2010/0006561 | A1 * | 1/2010 | Hensel | A47J 37/0635 219/483 |
| 2010/0054717 | A1 * | 3/2010 | Lee | F24C 15/327 392/401 |
| 2010/0178407 | A1 * | 7/2010 | Rizzuto | A21B 3/04 426/510 |
| 2010/0230396 | A1 * | 9/2010 | Boubeddi | F22B 1/284 219/399 |
| 2011/0142998 | A1 * | 6/2011 | Johncock | A47J 37/041 426/233 |
| 2011/0266271 | A1 * | 11/2011 | Boyer | F24C 15/00 219/393 |
| 2012/0017770 | A1 * | 1/2012 | Sakane | F24C 15/327 219/509 |
| 2013/0156906 | A1 | 6/2013 | Raghavan et al. | |
| 2013/0344214 | A1 * | 12/2013 | Tong | A21B 3/04 426/511 |

* cited by examiner

COMBINATION HEAT AND STEAM OVEN

FIELD OF THE INVENTION

The present invention relates to cooking appliances and, more particularly to a combination heat and steam oven having a self-cleaning feature.

BACKGROUND OF THE INVENTION

Various countertop oven appliances exist for heating and cooking a variety of food items. For example, toaster ovens use electrically powered heat elements to emit heat within an enclosed volume to heat food placed therein. Microwave ovens use microwaves to heat food on a molecular level. Each has advantages and disadvantages, depending on the type of food being cooked and the objectives of the user. In some instances, microwave ovens cook food faster but fail to brown or crisp the exterior of the food, while a toaster oven will do so. On the other hand, a toaster oven, in some instances, will cause food to be dry, particularly on the inside if, for example, the food is a piece of meat. Toaster ovens also typically require more time for cooking than microwave ovens.

Steam cooking ovens are another type of countertop cooking appliance which cook food items by using superheated steam. A water reservoir and heater are used to generate steam, which is introduced into the oven cavity, so that droplets of steam contacting the food in the oven will transfer the heat to the food.

While each of these known ovens is generally suitable for what is regarded as ordinary performance, there is room for improvement in terms of ease of use, performance, overall functionality and cleanliness. It is therefore desirable to provide a combination heat and steam over that overcomes the shortcomings of the oven systems mentioned above while achieving similar benefits of each such system hereinbefore described.

SUMMARY OF THE INVENTION

It is an object of the present invention to provide a combination heat and steam oven.

It is another object of the present invention to provide a combination heat and steam oven that combines heating elements for producing dry heat in addition to steam generating elements for producing steam heat in order to cook food using both sources of heat simultaneously.

It is another object of the present invention to provide a combination heat and steam oven that utilizes convection to heat food items.

It is another object of the present invention to provide a combination heat and steam oven operable in a variety of pre-programmed cooking modes.

It is another object of the present invention to provide a combination heat and steam oven that has preset and adjustable temperature and cook times.

It is another object of the present invention to provide a combination heat and steam oven having a self-cleaning feature.

It is an object of the present invention to provide a combination heat and steam oven having a digital display and controls.

It is an object of the present invention to provide a combination heat and steam oven having heating elements and a steam injector that are independently controllable.

A combination heat and steam oven according to the present invention includes a housing having an internal heating compartment, at least one dry heating element disposed within the heating compartment, a steam generating unit configured to produce steam for injection into the heating compartment, and a user interface. The user interface is configured for selectively controlling operation of the at least one dry heating element and the steam generating unit, so that the steam generating unit and the at least one dry heating element may be operated alone or simultaneously with the other of the steam generating unit and the at least one dry heating element.

According to another embodiment of the present invention, a combination heat and steam oven is provided. The oven includes a housing having an internal heating compartment, at least one dry heating element disposed within the heating compartment, a steam generating unit configured to produce steam for injection into the heating compartment, and a user interface for selectively controlling operation of the at least one dry heating element and the steam generating unit. The user interface is configured to control operation of the at least one dry heating element and the steam generating unit so that the steam generating unit and the at least one dry heating element may be operated alone or simultaneously with the other of the steam generating unit and the at least one dry heating element. The oven is selectively operable in a self-cleaning mode whereby the steam unit it activated at predetermined time intervals for a predetermined period of time to provide steam to the heating compartment.

According to another embodiment of the present invention a method of operating a combination heat and steam oven having a housing having an internal heating compartment, at least one dry heating element disposed within the heating compartment, and a steam-generating unit configured to produce steam for injection into the heating compartment is provided. The method includes the steps of activating at least one user control on a user interface to select among a plurality of pre-programmed cooking modes, the cooking modes including one or more of radiant heating, convection heating and steam heating, and depressing a start button to initiate the selected cooking mode.

DETAILED DESCRIPTION OF THE PREFERRED EMBODIMENTS

Figure 1:
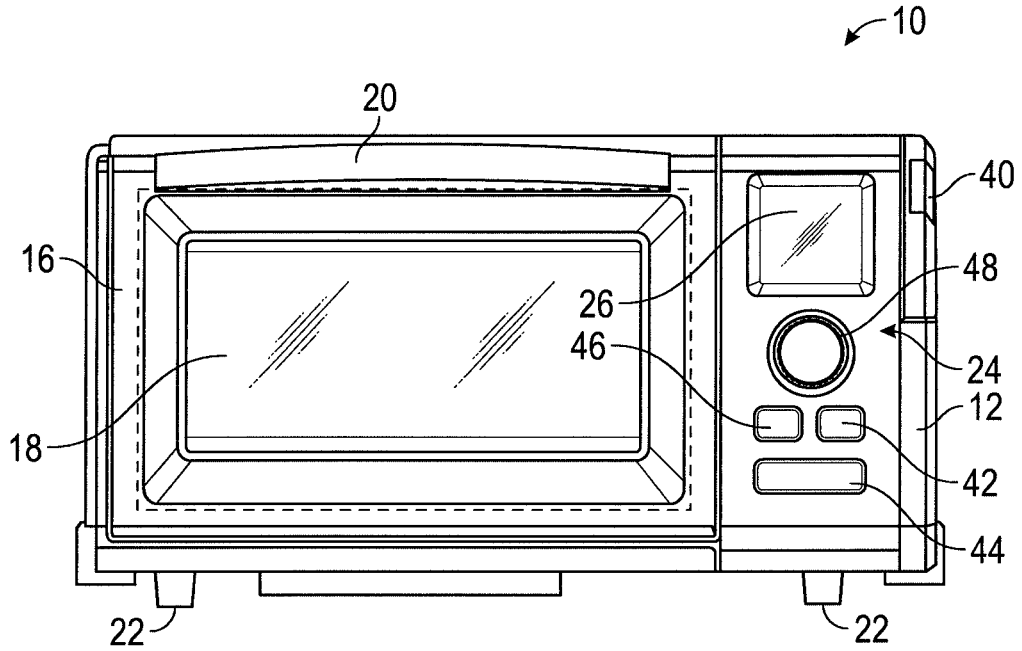
FIG. 1 is a front, elevational view of a combination heat and steam oven in accordance with an embodiment of the present invention.
Figure 2:
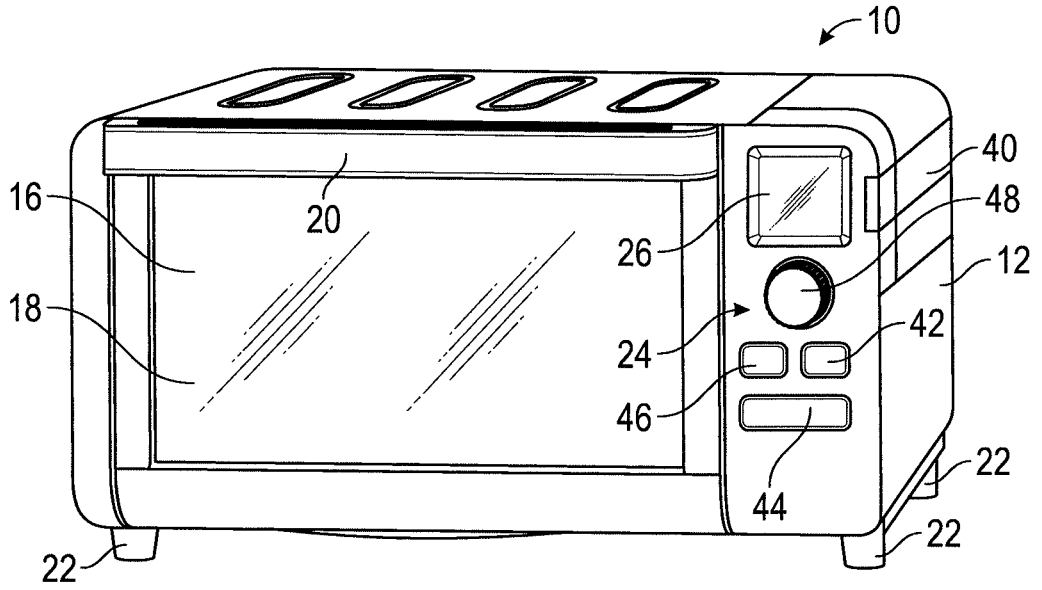
FIG. 2 is a perspective view of the combination heat and steam oven of FIG. 1.
Figure 3:
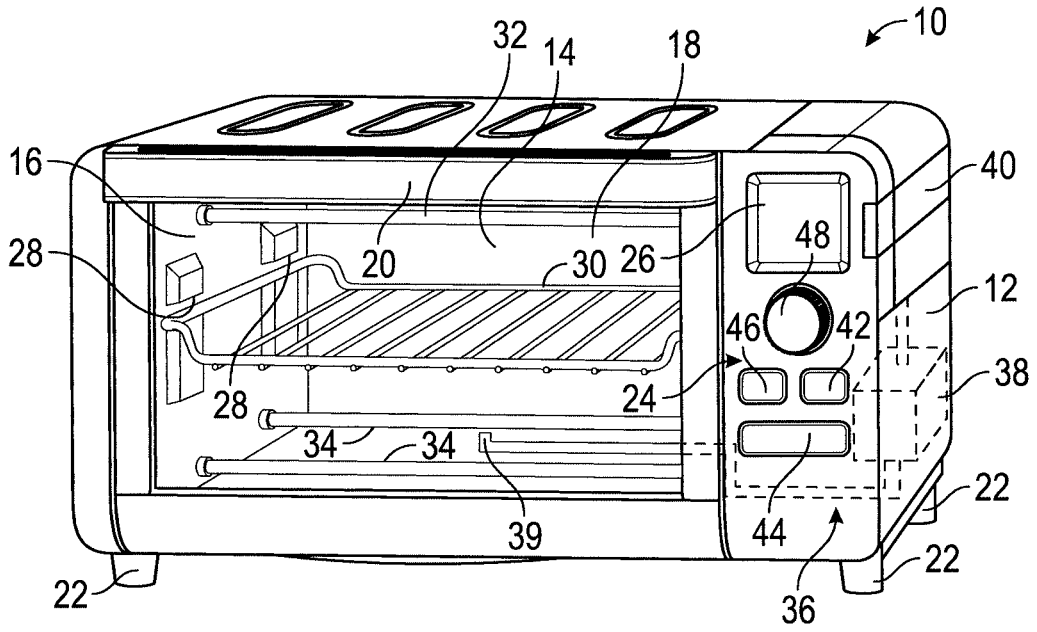
FIG. 3 is a perspective view of the combination heat and steam of FIG. 1 illustrating internal components thereof.

Referring to FIGS. 1-3, a combination heat and steam oven 10 is shown. The oven 10 substantially takes the form of a toaster oven and includes a thermally insulated housing 12 that defines an internal heating compartment 14. The compartment 14 may be accessed through a door 16 having a transparent front panel 18. In an embodiment, the door 16 is pivotally connected to the housing 12 at a lower edge thereof. As shown therein, the door 16 also has a handle 20 allowing a user to open the door 16 to provide access to the compartment 14. A plurality of feet 22 support the housing 12 in spaced relation to a countertop or other surface.

As further shown in FIG. 1, the front of the housing 12 includes a user interface 24 comprising a graphic display 26, such as a LCD, and an array of user controls configured to control various functions including activating heat from either dry heating elements or a steam heater, controlling temperature settings, setting automatic timers, setting displays, setting alarms, and other functions, as discussed hereinafter.

As best shown in FIG. 3, the internal compartment 14 may include one or more pairs of opposed slots 28 for slidably receiving one or more removable racks 30. As also shown therein, the internal compartment 14 is heated by a plurality of electric dry heating elements 32, 34 which are configured to produce radiant heat. In an embodiment, two heating elements 32 are located adjacent to the ceiling or top of the compartment 14 and two heating elements 34 are located along the floor or bottom of the compartment 14. In an embodiment, the heating elements 32, 34 include any one or more of known elements used in electric toaster ovens and electric mini-ovens and broilers. The heating elements 32, 34 may be, for example, Calrod® heaters, such as stainless steel Calrod® heaters, although any other type of heating element known in the art, such as quartz, tungsten, halogen, etc., may also be utilized without departing from the broader aspects of the present invention.

With specific reference to FIGS. 3, the combination heat and steam oven 10 of the present invention also includes a steam unit 36 configured to produce steam for injection into the oven compartment 14. In an embodiment, the steam unit 36 includes a steam generator, such as, for example, a boiler 38, an injection nozzle 39 fluidly coupled to the boiler 38 for directing steam into the heating compartment 14, and a fluid reservoir 40 mounted to the housing 12 for supplying water to the boiler 38 for conversion into steam.

In an embodiment, the boiler 38 includes an electric heating element configured to heat water within the boiler to produce steam in a manner known in the art. In addition, a steam pump (not shown) may be included and used to enhance delivery of the steam generated by the boiler 38 to the injection nozzle 39. Reservoir 40 may be a permanently mounted tank or a refillable, removable container.

As shown in FIG. 3, the injection nozzle 39 has a single outlet. In other embodiments, however, the tube supplying steam to the injection nozzle 39 may have more than one opening in it to emit steam into the compartment 14. The steam may be generated and released continuously or intermittently.

Importantly, during operation, the dry heat elements 32, 34 provide radiant heat to aid in browning certain types of food during cooking, a feature not attainable with steam cooking, and it contributes additional heat to that generated by steam. This combination of steam, radiant heat, and convective heat transfer produces faster cook times than these methods used separately.

With further reference to FIGS. 2 and 3, the user interface 24 is electrically connected to, and configured to control, operation of the heating elements 32, 34 and the steam unit/steam generator 36. In particular, the user interface 24 includes a microprocessor (not shown) and control circuitry configured to control the heating elements 32, 34 and steam unit 36 in dependence upon a user input, and according to control algorithms stored in memory. Importantly, the upper and lower heating elements 32, 34, as well as the steam unit 36, are independently controllable by the microprocessor and control circuitry to selectively provide a variety of cooking modes.

As shown therein, the user interface 24 may have a button 42 for activating an internal light, a button 44 for starting or canceling a cooking cycle, and a button 46 for initiating an automatic cleaning of the oven 10, as discussed hereinafter. The user interface 24 also has a depressible and rotatable knob 48 for selecting a function, a time, a temperature, or a shade, and for selective or preprogrammed activation of heating elements 32, 34 and/or steam unit 36 for radiant, convection and/or steam heating of food items, as shown on display 26. Importantly, the user interface 24 allows a user to quickly and easily selectively active the upper heating elements 32, lower heating elements 34 and steam unit 36 by choosing a pre-programmed cooking mode. In connection with this, it is an important aspect of the present invention that the upper heating elements 32, lower heating elements 34 and steam unit 36 may be activated in conjunction with one another, or controlled independently, as desired. Indeed, the duration and time intervals of steam injection, as well as the duration and power of the heating elements 32, 34 (at a wattage between zero power to full power) may be selectively controlled using the interface 24.

As indicated above, a user may select a mode by rotating the knob 48 until the desired mode appears on the graphic display 26. In an embodiment, a user may select between, at least, the following modes: toast, convection bake, super steam, broil and warm/preheat. In each of these modes, the microprocessor controls the upper and lower heating elements 32, 34 and the steam unit 36 according to a specific control algorithm to precisely heat or cook a desired food product.

As will be readily appreciated, independent control of the upper and lower heating elements 32, 34 and the steam unit 36 allows a user to more precisely tailor a cooking/heating cycle to the type of food item placed within the heating compartment 14, resulting in better tasting and looking food. In addition, control over the heating elements 32, 34 and steam unit 36 allows the toaster over 10 to be utilized to heat or cook food items that would normally not be well suited to cooking in conventional toaster ovens or steam ovens, respectively.

The combination heat and steam oven 10 also includes a self-cleaning feature that may be selectively activated to clean the oven 10. In operation, once the oven 10 is plugged in and turned on, it is in a standby mode. At any time prior to initiating a cooking cycle, a user may depress the auto-clean button 46. This prompts the LCD display 26 to display a message indicating that the oven 10 is ready to initiate cleaning. Depressing the auto-clean button once again initiates an auto-clean cycle, and a count-down timer for the cycle is displayed on display 26. The microprocessor, operating according to a set of instructions stored in memory, cycles the boiler 38, i.e., the boiler heats up and turns off, preferably 40 seconds on and 20 seconds off, with enough heat to generate steam. The steam injection nozzle 39 injects the generated steam into the compartment 14 to effect cleaning of the compartment 14 and the components disposed therein. In operation, as steam leaves the boiler chamber, the low pressure allows water from the tank 40 to enter under gravity, where it is heated and converted into steam and injected into the compartment 14 once again. This cycle repeats until the timer expires in order to clean the inside of the oven 10 and the steam nozzle.

Figure 4:
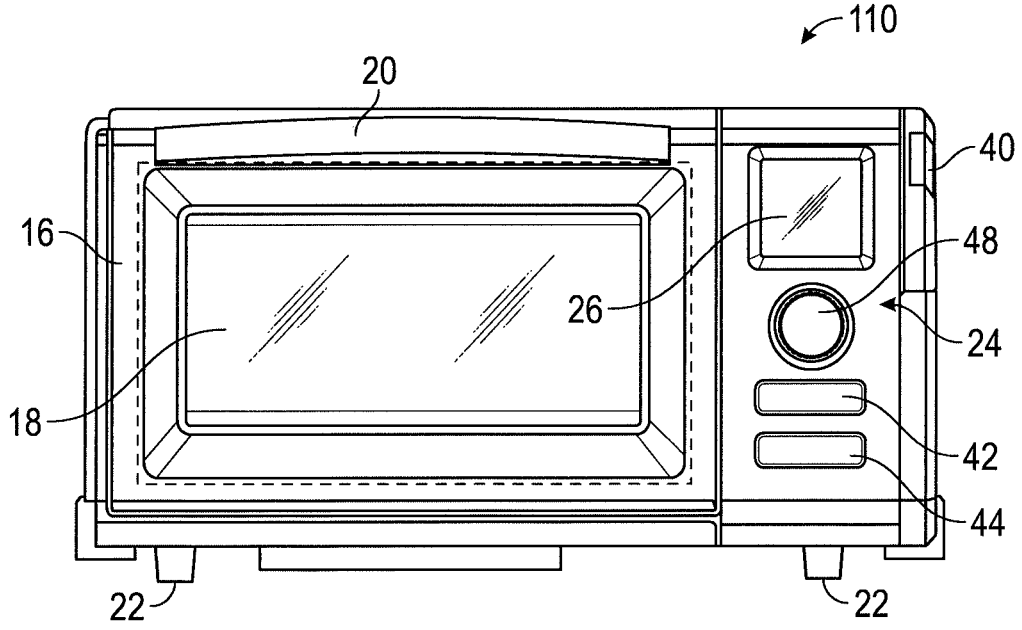
FIG. 4 is a front, elevational view of combination heat and steam oven according to another embodiment of the present invention.

Referring now to FIG. 4, a combination heat and steam oven 110 according to another embodiment of the present invention is shown. As will be readily appreciated, the combination heat and steam oven 110, shown therein, is substantially identical to the combination heat and steam oven 10 described above and shown in FIGS. 1-3, like reference numerals designating like components. Notably, however, combination heat and steam oven 110 does not have an auto-clean button or the capability of self-cleaning. Moreover, operation of the oven 110 is substantially identical to that of oven 10 in all respects, including the provision of radiant heating, convection heating and steam heating. As noted, however, the combination heat and steam oven 110 is not programmed for, and is not capable of operating in, a self-cleaning or auto-clean mode.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A toaster oven, comprising:

a housing, said housing including an integral door for selectively allowing entry into a cooking chamber of said housing;

a steam generation unit including a boiler exterior to said cooking chamber for heating supplied water to a temperature sufficient to change said supplied water into steam, and a steam pipe extending into said cooking chamber and having a distal end positioned adjacent to a bottom of said cooking chamber, said steam pipe having a plurality of outlets at said distal end for permitting egress of said steam produced in said boiler into said cooking chamber;

an electric heating assembly including a first set of heating elements and a second set of heating elements positioned within said cooking chamber between a top wall and a bottom wall of said cooking chamber, wherein said first set of heating elements and said second set of heating elements are juxtaposed with said steam pipe and said plurality of outlets in said interior portion of said cooking chamber between said top wall and said bottom wall of said cooking chamber;

a manually actuatable control system integrated with said housing, said manually actuatable control system selectively operating said steam generation unit and electric heating assembly according to instructions stored in memory; and wherein said manually actuatable control system is configured such that an actuation thereof initiates an auto-clean cycle whereby, under control of a microprocessor in communication with the manually actuatable control system and operating according to said instructions stored in memory, the boiler of the steam generating unit is cycled on and off multiple times over a predetermined period of time so as to cause said steam generation unit to issue bursts of steam into said cooking chamber via said plurality of outlets, in a cyclic fashion, over the predetermined period of time without further manipulation of said manually actuatable control system by a user;

wherein the manually actuatable control system includes a user interface configured to allow a user to select a duration and time interval of steam injection into the cooking chamber during a cooking operation.

2. A toaster oven, comprising:

a housing defining an interior cooking chamber;

a heating assembly including a first set of heating elements positioned adjacent to a top wall of the interior cooking chamber and a second set of heating elements positioned adjacent to a bottom wall of the interior cooking chamber;

a steam generation unit in operative communication with said interior cooking chamber, said steam generation unit including a boiler exterior to said cooking chamber for heating supplied water to a temperature sufficient to change said supplied water into steam, and a steam pipe for permitting egress of said steam produced in said boiler into said interior cooking chamber, said steam pipe including at least one outlet in a distal end thereof, said distal end and said at least one outlet being located adjacent to a bottom of said interior cooking chamber and intermediate first and second heating elements of said second set of heating elements; and a control system integrated with said housing for selectively operating said steam generation unit and said heating assembly;

wherein the control system includes a user interface configured to allow a user to select a duration and time interval of steam injection into the interior cooking chamber during a cooking operation; and wherein said toaster over further includes a steam pump to increase delivery of steam to the interior cooking chamber.

3. A toaster oven, comprising:

a housing defining a cooking chamber;

a steam generation unit exterior to said cooking chamber in operative communication with said cooking chamber, said steam generation unit including a steam pipe extending into said cooking chamber and having a distal end having a plurality of outlets located adjacent to a bottom wall of said housing, said plurality of outlets permitting egress of steam produced in said steam generation unit into said cooking chamber;

a heating assembly including a first set of heating elements and a second set of heating elements positioned within said cooking chamber, wherein said first set of heating elements and said second set of heating elements are juxtaposed with said steam pipe and said plurality of outlets in said interior portion of said cooking chamber between said top wall and said bottom wall of said cooking chamber;

a control system in operative control of said steam generation unit; and wherein upon user-initiation of an auto-clean cycle, said control system is configured to cause a boiler of said steam generation unit to cycle on and off multiple times until expiration of a timer, the multiple times of cycling said boiler on and off causing said steam generation unit to issue more than one burst of steam into said cooking chamber, wherein initiation of the auto-clean cycle is carried out by actuation of a manually operable button in communication with said control system; and wherein each cycling on of the boiler corresponds to a single burst of steam into said cooking chamber;

wherein the control system includes a user interface configured to allow a user to select a duration and time interval of steam injection into the cooking chamber during a cooking operation; and wherein said toaster over further includes a steam pump to enhance delivery of steam to the cooking chamber.

4. The toaster oven according to claim 3, wherein:

each of said first set of heating elements and said second set of heating elements of said heating assembly comprising a pair of parallel and linear heating rods extending from one side of said cooking chamber to an opposing side between said top wall and said bottom wall of said cooking chamber; and said steam pipe is linear and positioned between and parallel to said pair of linear heating rods.

5. The toaster oven according to claim 4, wherein:

said plurality of outlets of said steam pipe are positioned in said inner portion of said cooking member between said liner heating rods.

6. The toaster oven of claim 1, wherein:

the manually actuatable control system is configured to carry out the auto-clean cycle prior to initiation of a cooking function.

7. The toaster oven of claim 2, wherein:

said control system is configured to operate said steam generation unit in an auto-clean mode, whereby in said auto-clean mode said control system cycles said boiler on and off multiple times over a predetermined duration such that each time said boiler is cycled on a single burst of steam is provided to said interior cooking chamber;

wherein said auto-clean mode is carried out automatically upon initiation by a user;

wherein said toaster oven further includes a water reservoir disposed above the steam generation unit; and wherein the steam generation unit, water reservoir and steam pipe are configured such that during the auto-clean cycle, as steam leaves the boiler, low pressure in the boiler allows water from the water reservoir to enter the boiler under gravity, where it is heated and converted into steam and injected into the cooking chamber.

* * * * *